US008491147B1

(12) United States Patent
Bardash, Jr.

(10) Patent No.: US 8,491,147 B1
(45) Date of Patent: Jul. 23, 2013

(54) METHOD OF PRESENTING A CHRISTMAS STAR DECORATION

(76) Inventor: Thomas Bardash, Jr., Ponce Inlet, FL (US)

( * ) Notice: Subject to any disclaimer, the term of this patent is extended or adjusted under 35 U.S.C. 154(b) by 425 days.

(21) Appl. No.: 12/951,891

(22) Filed: Nov. 22, 2010

(51) Int. Cl.
*F21S 4/00* (2006.01)
*F21S 6/00* (2006.01)

(52) U.S. Cl.
USPC ..... 362/121; 362/249.17; 362/249.14

(58) Field of Classification Search
USPC ..... 362/121, 122, 123, 566, 231, 234, 362/253, 653, 249.06, 249.14–249.19, 806, 362/807, 808
See application file for complete search history.

(56) References Cited

U.S. PATENT DOCUMENTS 5,967,823 A * 10/1999 Tsui ..... 439/280
6,019,494 A * 2/2000 Lee ..... 362/249.01
6,033,088 A * 3/2000 Contigiani ..... 362/249.14
6,386,734 B1 * 5/2002 Huang ..... 362/249.09
6,709,145 B1 * 3/2004 Huang ..... 362/565
2001/0043472 A1 * 11/2001 Gibboney, Jr. ..... 362/240
2003/0174515 A1 * 9/2003 Huang ..... 362/551

* cited by examiner

*Primary Examiner* — Bao Q Truong
(74) *Attorney, Agent, or Firm* — Gold & Rizvi, P.A.; H. John Rizvi

(57) ABSTRACT

A method of presenting a lighted decorative star as a holiday decoration is accomplished by forming holes in a plurality of rigid strips of a defined length and then arranging the rigid strips in a star pattern of substantially equal arced radials such that a first end of each rigid strip is proximate to a common center and a second end is radially distant from the common center. A light string having a plurality of interconnected decorative lights is placed proximate to one side of the star pattern. An empty light socket of one of the a decorative lights is placed at each hole and a decorative light bulb is affixed in each light socket such that the portion of the rigid strip defining the hole through which the decorative light bulb is inserted is held captive between the respective light socket and decorative light bulb.

12 Claims, 7 Drawing Sheets

METHOD OF PRESENTING A CHRISTMAS STAR DECORATION

FIELD OF THE INVENTION

The present disclosure generally relates to methods for constructing and presenting a holiday decoration. More particularly, the present disclosure relates to a method for constructing and presenting an outdoor Christmas star decoration.

BACKGROUND OF THE INVENTION

Festive decorations consistent with various holidays have become more and more popularized in society. One can find decorations of one sort or another associated with almost every major and some minor holidays. Reds hearts and images of Cupid are prevalent in February for Valentine's Day and red, white and blue decorations are prevalent to show patriotism for Independence Day in July. Halloween and, shortly thereafter, Thanksgiving elicit fall colors, harvest themes, and images of witches, goblins and jack-o-lanterns.

However, by far the most decorative holiday of the year is the Christmas holiday in December. The origins of the Christmas holiday are predicated on celebrating the birth of Jesus and thus in its most recent form, the holiday has had religious connotations. The very earliest origin for a winter festival, may be based upon pagan traditions at the winter solstice. Somewhere in the $16^{th}$ to $18^{th}$ centuries, the Christmas tree was introduced into the holiday celebration and the degree and extent of decorations have expanded ever since. Regardless of its origins, the Christmas holiday has evolved into a major celebration around the world that combines secular and religious aspects and is associated with family gatherings, religious rites, goodwill, gift giving and decorative displays that include a variety of indoor and outdoor light arrangements.

While individuals decorate their homes with indoor displays of Christmas trees adorned with lights and ornaments and outdoor light displays adorning the exterior of the house, other lawn ornaments and trees, municipalities and commercial businesses also erect holiday decorations to add a festive nature to public areas and commercial properties. These outdoor decorations and light displays tend to be of a larger and often more elaborate nature to promote visibility from longer physical distances. Further, these displays tend to be secular in nature rather than religious and include displays such as candy canes, Santa Clauses, reindeer, trees, and other decorative elements designed to catch the eye of passersby. One popular decorative element that is often used in light displays is that of a star. The star has both secular and religious meanings and has its origins in the story of the magi following the Star of Bethlehem. With the popularity of a star as a holiday decoration, there is therefore a need for a star display and method of presenting the star display for viewing.

SUMMARY OF THE INVENTION

The present disclosure is generally directed to a method of presenting a lighted decorative star as a holiday decoration. The presentation is accomplished by forming holes in a plurality of rigid strips of a defined length and then arranging the rigid strips in a star pattern of substantially equal arced radials such that a first end of each rigid strip is proximate to a common center and a second end is radially distant from the common center. A light string having a plurality of interconnected decorative lights is placed proximate to one side of the star pattern. An empty light socket of one of the a decorative lights is placed at each hole and a decorative light bulb is affixed in each light socket such that the portion of the rigid strip defining the hole through which the decorative light bulb is inserted is held captive between the respective light socket and decorative light bulb.

Yet another aspect of the invention is directed to a method of presenting a lighted decorative star as a holidays decoration. The presentation is accomplished by forming holes in a plurality of rigid strips of a defined length and then arranging the rigid strips in a star pattern of substantially equal arced radials such that a first end of each rigid strip is proximate to a common center and a second end is radially distant from the common center. A light string having a plurality of interconnected decorative lights is placed proximate to one side of the star pattern. An empty light socket of one of the a decorative lights is placed at each hole and a decorative light bulb is affixed in each light socket such that the portion of the rigid strip defining the hole through which the decorative light bulb is inserted is held captive between the respective light socket and decorative light bulb. The completed star with affixed lights is then mounted on an outdoor display structure at a location to be decorated and electrical power is supplied to illuminate the lights on the star.

In some embodiments, the rigid strips may include four substantially equally spaced holes in each rigid strip, while in other embodiments the rigid strips may include five substantially equally spaced holes in each rigid strip.

In another aspect, the star is arranged with twelve rigid strips that are radially arranged substantially twelve equal arcs.

These and other features, aspects, and advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, where like numerals denote like elements and in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
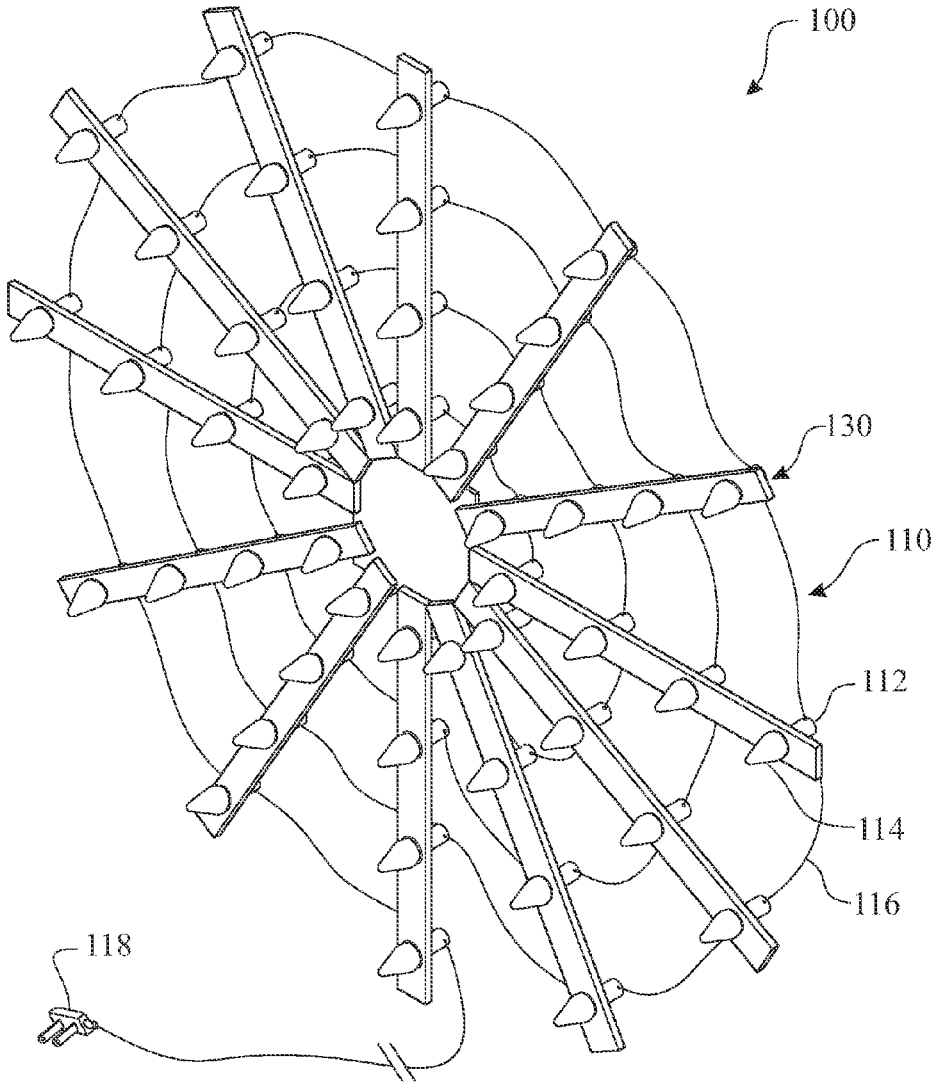
FIG. 1 presents a front perspective view of a star assembly including a string of lights affixed thereto embodying the invention and having a plurality of radially extending members defining holes receiving individual lights.
Figure 2:
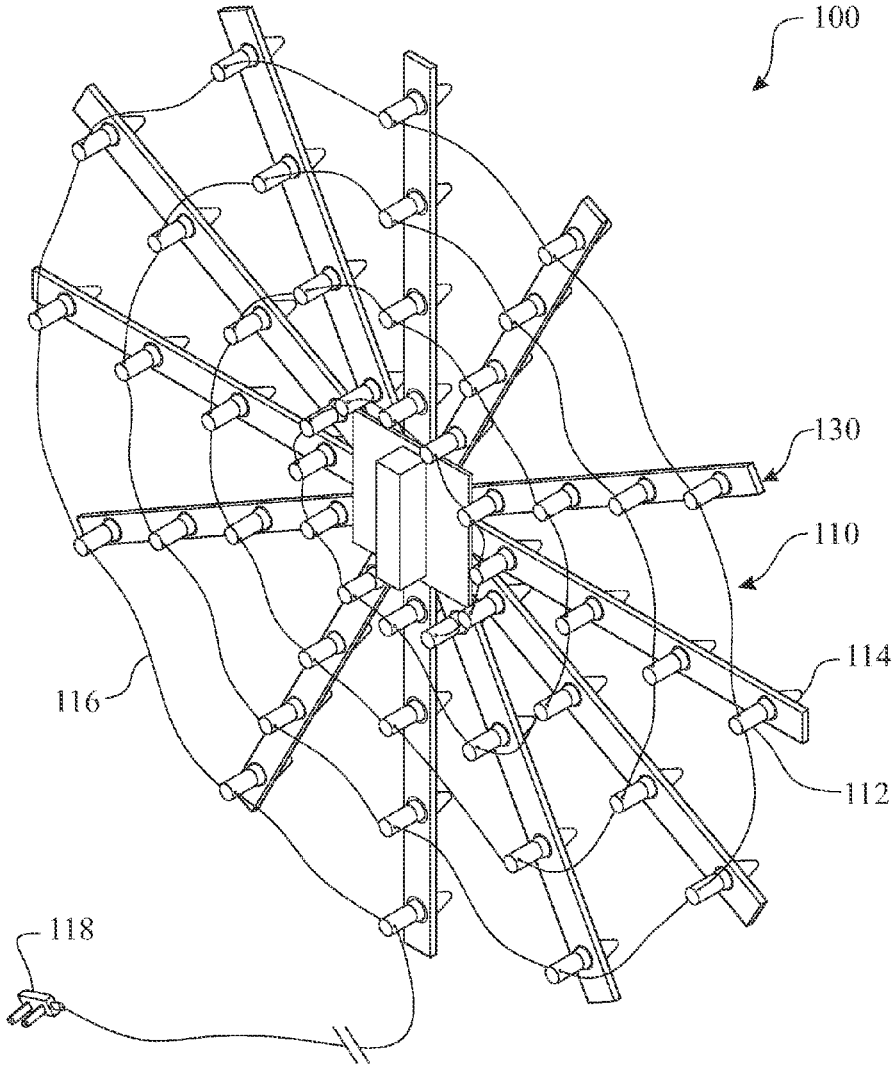
FIG. 2 presents a rear perspective view of the star populated with lights.

Turning to the drawings, FIGS. 1-2 show a light populated star assembly 100 which is one of the preferred embodiments of the present invention and illustrates its various components. Populated star assembly 100 includes a star assembly 130 and an electrical light string 110 affixed to star assembly 130. Electrical light string 110 having a plurality of light sockets 112 which receive individual light bulbs 114. Light sockets 112 are electrically interconnected by conductive wiring 116 having a plug 118 at one end thereof for connecting with an electrical power supply (not shown). Light bulbs 114 can be either clear, white, or multi colored with a variety of orange, red, blue, and green lights all in a manner well known in the art of decorative lights.

Figure 3:
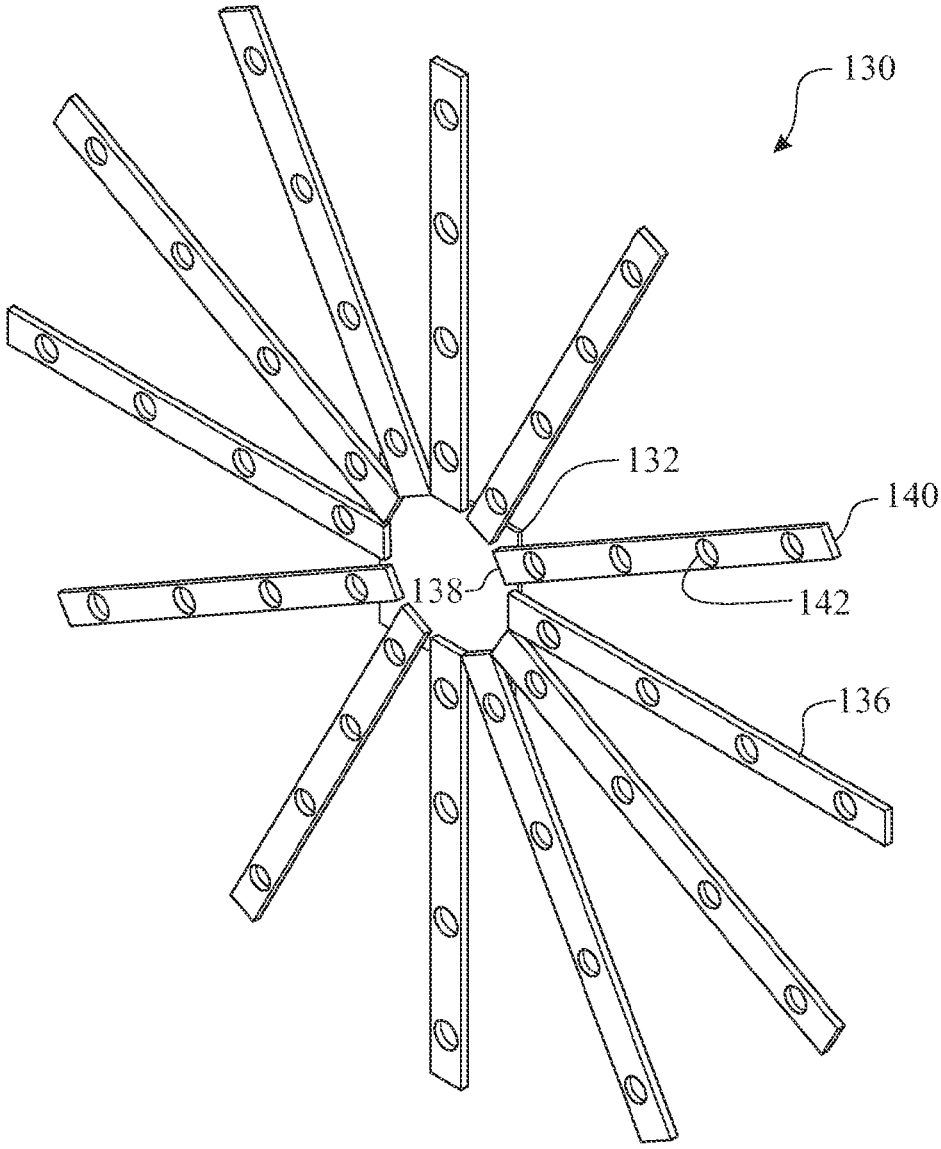
FIG. 3 presents a front perspective view of the star assembly having a plurality of radially extending members defining holes for receiving individual lights.
Figure 4:
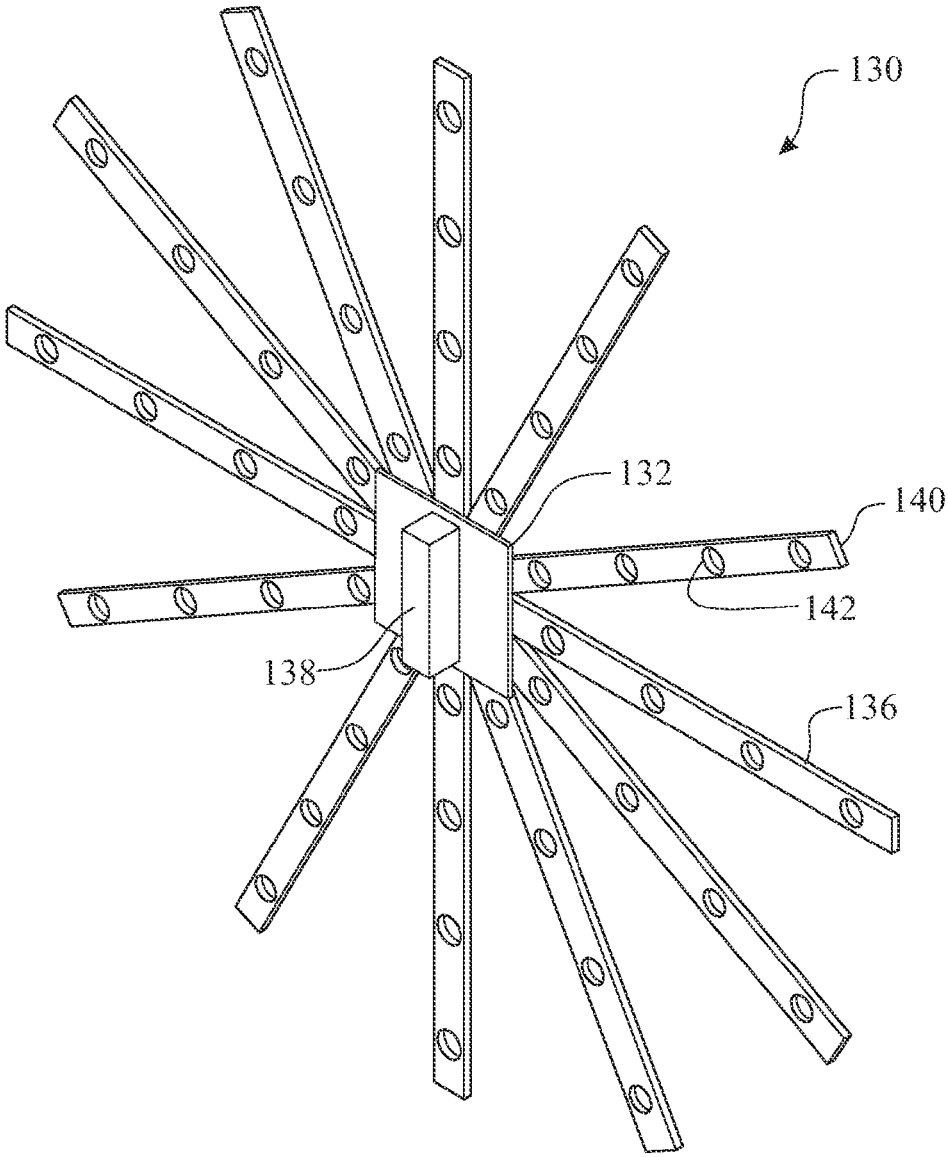
FIG. 4 presents a rear perspective view of the star assembly.

Star assembly 130, more clearly illustrated in FIGS. 3-4, includes a central base 132 having a mount 134 affixed thereto for mounting of the populated star assembly 100 on a support structure. Central base 132 can be of rectilinear, circular or other polygonal shape and has affixed about a periphery thereof a plurality of radially extending rigid strips 136. Star assembly 130 is illustrated with twelve rigid strips 136 extending outwardly from central base 132 and spaced at substantially equally arced intervals. However, those practiced in the art will recognize that other quantities of rigid strips 136 can be used to create a radiating start effect.

Figure 5:
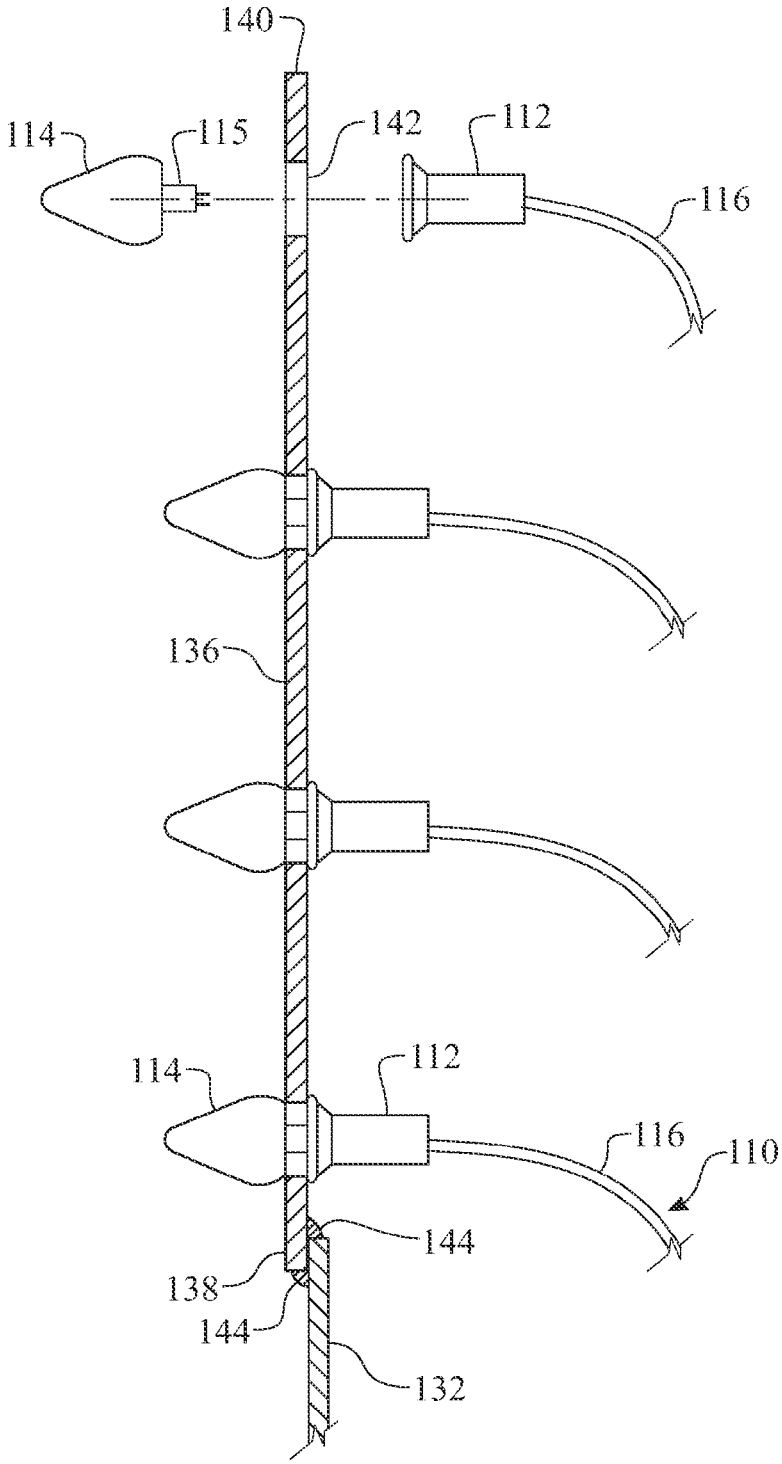
FIG. 5 presents a partial sectional view of a radial member illustrating the insertion of lights in the holes.

Each rigid strip 136 has a first end 138 positioned proximate to a center of star assembly 130 and is firmly affixed to base 132. While the method of attachment of each rigid strip in the preferred embodiment is by weld beads 144 as shown in FIG. 5, other known methods of mechanical attachment, such as with bolts and nuts (not shown), are also contemplated within the scope of the invention. A second end 140 of each rigid strip 136 is positioned radially distant from the common center approximated by base 132.

As illustrated in FIGS. 3-4, each rigid strip 136 defines four equally spaced holes 142 extending along a length of rigid strip 136. As further illustrated in FIG. 5, each hole 142 is sized to receive therethrough the stern 115 of a light bulb 114. To install the light string 110 on star assembly 130, the light bulbs 114 are removed from their respective sockets 112. A socket 112 is placed behind a hole 142 in a rigid strip 136 and the stem 115 of a light bulb 114 is inserted through hole 142 into socket 112 and bulb 114 is then secured in socket 112. Securing of light bulbs 114 can be by one of existing known configurations such as by threads, partial turns to captivate the bulb 114, or by friction, in this manner and as shown in FIG. 5, the portion of rigid strip 136 defining a hole 142 is held captive between light bulb 114 and socket 112 thus retaining bulb 114 and socket 112 in the desired radial star pattern.

A presentation of a lighted decorative star assembly 100 as a holiday decoration can be accomplished by forming holes 142 in a plurality of rigid strips 136 having a defined length and then arranging the rigid strips 136 in a star pattern of substantially equal arced radials such that a first end 138 of each rigid strip 136 is proximate to a common center such as central base 132 and a second end 140 of each rigid strip 136 is radially distant from the common center. A fight string 110 having a plurality of interconnected decorative lights is placed proximate to one side of the star pattern such as the rear of star assembly 110. An empty light socket 112 of one of the a decorative lights is placed at each hole 142 and a decorative light bulb 114 is affixed in each light socket 112 such that the portion of the rigid strip 136 defining the hole 142 through which the decorative light bulb 114 is inserted is held captive between the respective light socket 112 and decorative light bulb 114.

Figure 7:
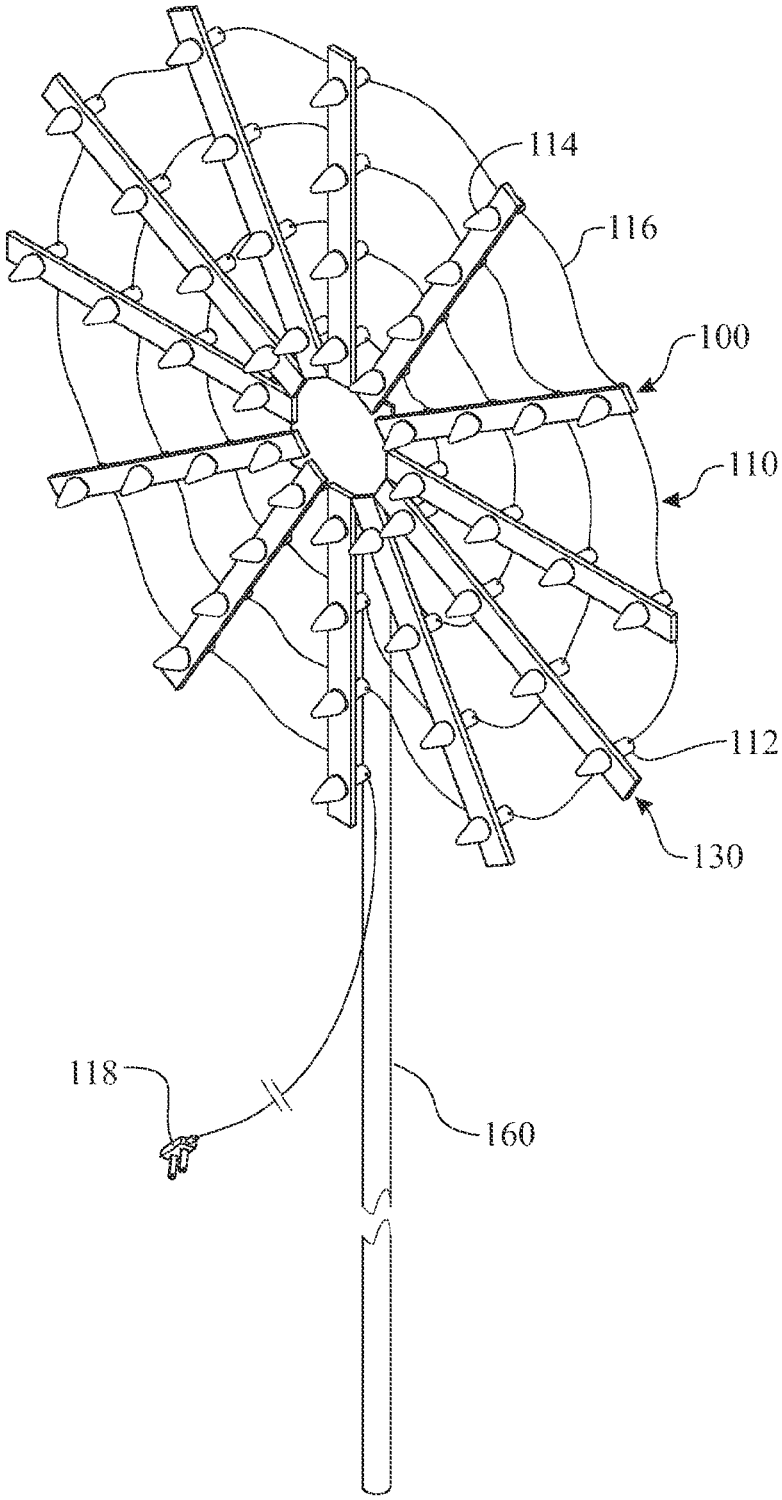
FIG. 7 presents a front perspective view of the populated star mounted on an outdoor display structure.

Referring now to FIG. 7, the light string 110 has all of its light bulbs 114 inserted into sockets 112 to hold captive upon rigid strips 136 thereby completing light populated star assembly 100, light populated star assembly 100 can then be affixed to an outdoor support structure such as pole 160 or other similar support structure (not shown) interfacing with mount 134 of central base 132. Plug 118 can then be connected to an electrical power source (not shown) to illuminate populated star assembly 100.

Figure 6:
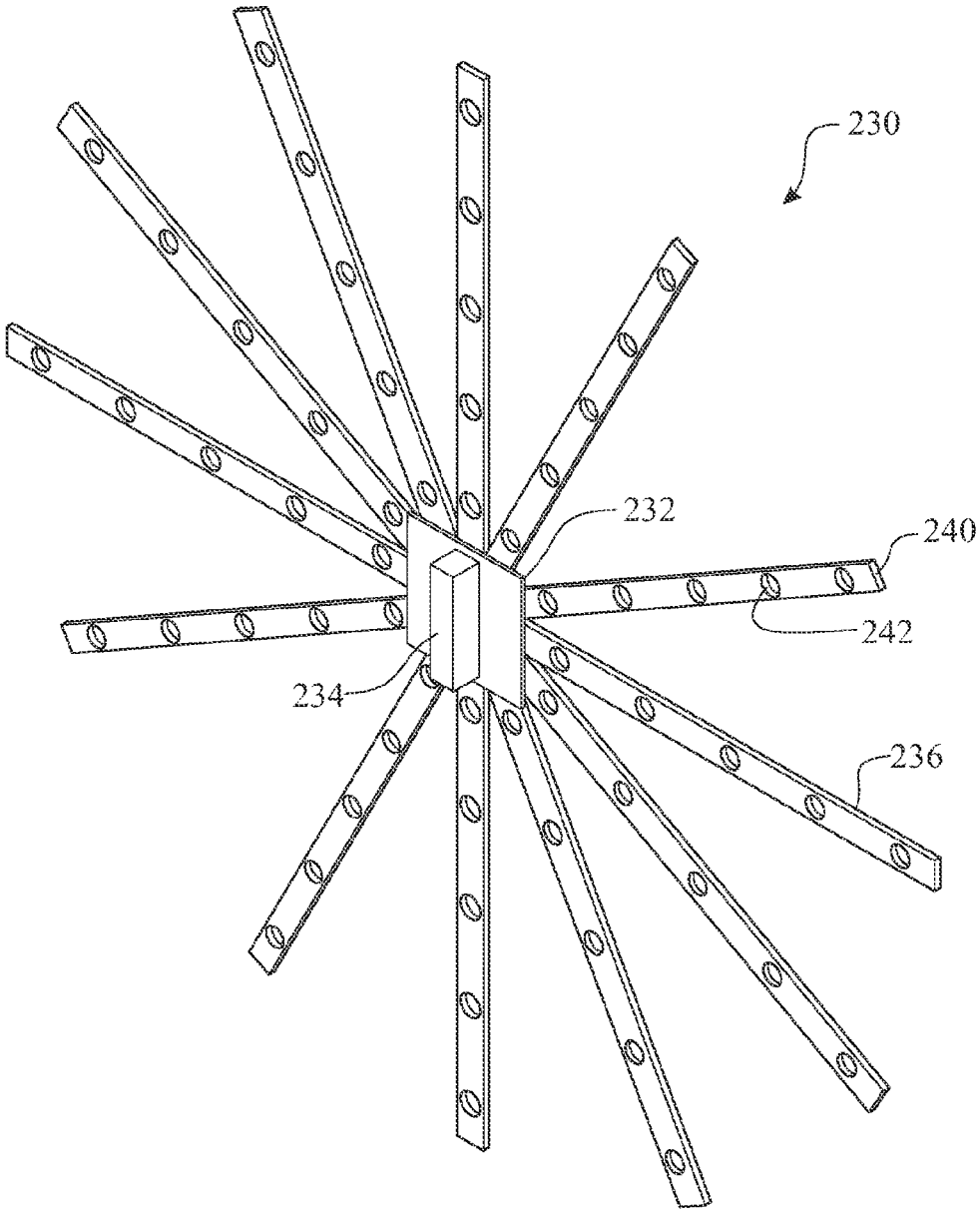
FIG. 6 presents a rear perspective view of an alternate embodiment of the star assembly.

FIG. 6, illustrates an alternate embodiment star assembly 210. Star assembly 210 is similar to star assembly 110. However, each of the rigid strips 236 of star assembly radiating outwardly from central base 232 and mount 234 define five substantially equally spaced holes 242. Thus, star assembly 210 can be utilized to provide a star display that has a larger diameter if the spacing of holes 242 are the same as the spacing of holes 142 in star assembly 110, or alternatively can provide a denser light concentration if the length of rigid strips 236 is substantially the same as the length of rigid strips 136 of star assembly 110.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A method of presenting a lighted decorative star as a holiday decoration comprises the steps of:

forming holes in a plurality of rigid strips of a defined length;

arranging the rigid strips in a star pattern of substantially equally arced radials such that a first end of each rigid strip is proximate to a common center and a second end is radially distant from the common center;

placing a light string having a plurality of interconnected decorative lights proximate to one side of the star pattern;

positioning an empty light socket of a decorative light at each hole; and affixing a decorative light bulb in each light socket such that the portion of the rigid strip defining the hole through which the decorative light bulb is inserted is held captive between the light socket and the decorative light bulb.

2. The method of presenting a lighted decorative star according to claim 1 wherein the forming steps results in four substantially equally spaced holes along the length of the rigid strip.

3. The method of presenting a lighted decorative star according to claim 1 wherein the forming steps results in five substantially equally spaced holes along the length of the rigid strip.

4. The method of presenting a lighted decorative star according to claim 1 wherein the arranging step results in twelve radially arranged rigid strips forming the decorative star.

5. The method of presenting a lighted decorative star according to claim 1 wherein the affixing step affixes lights of a uniform color in every light socket.

6. The method of presenting a lighted decorative star according to claim 1 wherein the affixing step affixes lights of at least two different colors in the light sockets.

7. A method of presenting a lighted decorative star as a holiday decoration comprises the steps of:

forming holes in a plurality of rigid strips of a defined length;

arranging the rigid strips in a star pattern of substantially equally arced radials such that a first end of each rigid strip is proximate to a common center and a second end is radially distant from the common center;

placing a light string having a plurality of interconnected decorative lights proximate to a rear of the star pattern;

positioning an empty light socket of a decorative light at a rear of each hole;

affixing a decorative light bulb in each light socket at a front of each hole such that the portion of the rigid strip defining the hole through which the decorative light bulb is inserted is held captive between the light socket and the decorative light bulb;

mounting the star patterned rigid strips and affixed lights on an outdoor display structure; and supplying electrical power to the light string to illuminate the lights.

8. The method of presenting a lighted decorative star according to claim 7 wherein the forming steps results in four substantially equally spaced holes along the length of the rigid strip.

9. The method of presenting a lighted decorative star according to claim 7 wherein the forming steps results in five substantially equally spaced holes along the length of the rigid strip.

10. The method of presenting a lighted decorative star according to claim 7 wherein the arranging step results in twelve radially arranged rigid strips forming the decorative star.

11. The method of presenting a lighted decorative star according to claim 7 wherein the affixing step affixes lights of a uniform color in every light socket.

12. The method of presenting a lighted decorative star according to claim 1 wherein the affixing step affixes lights of at least two different colors in the light sockets.

* * * * *